US006040106A

United States Patent [19]

Hori et al.

[11] Patent Number: 6,040,106

[45] Date of Patent: Mar. 21, 2000

[54] POROUS PHOTORECEPTOR AND METHOD FOR MANUFACTURING THE SAME

[75] Inventors: Takeshi Hori; Tsutomu Uezono; Tomoyuki Yoshii; Yasuhiro Funayama, all of Tokyo, Japan

[73] Assignee: NEC Corporation, Tokyo, Japan

[21] Appl. No.: 09/267,678

[22] Filed: Mar. 15, 1999

[30] Foreign Application Priority Data

Mar. 16, 1998 [JP] Japan ..... 10-065790

[51] Int. Cl.[7] ..... G03G 5/04

[52] U.S. Cl. ..... 430/127; 430/132; 430/133; 430/134

[58] Field of Search ..... 430/127, 132, 430/133, 134

[56] References Cited

U.S. PATENT DOCUMENTS 3,826,949 7/1974 Nakamura et al. ..... 313/109.5
4,739,591 4/1988 Everhardus et al. ..... 430/127
5,424,368 6/1995 Miyazaki et al. ..... 430/195

FOREIGN PATENT DOCUMENTS 9-204092 8/1997 Japan .
9-237976 9/1997 Japan .

*Primary Examiner*—Roland Martin
*Attorney, Agent, or Firm*—Young & Thompson

[57] ABSTRACT

A method for manufacturing a photoreceptor includes the steps of consecutively forming a transparent conductive layer, a photoconductive layer, insulation layer and an electrode layer on a transparent support member, covering the electrode layer with a photo-setting dry film having a mask pattern therein, and sand-blasting the electrode layer and the insulation layer through the mask pattern to form an array of pores in the electrode layer and the insulation layer. A porous layer having a uniform thickness and uniform arrangement of pores can be obtained.

11 Claims, 9 Drawing Sheets

POROUS PHOTORECEPTOR AND METHOD FOR MANUFACTURING THE SAME

BACKGROUND OF THE INVENTION (a) Field of the Invention

The present invention relates to a method for manufacturing a photoreceptor drum for use in a copying machine, a facsimile machine, a printer, or a like apparatus, and more particularly to a photoreceptor (hereinafter referred to as a "porous photoreceptor") having a surface formed as a porous layer, in which a large number of equally spaced fine pores are formed, and to a method for manufacturing the porous photoreceptor. The present invention also relates to a porous photoreceptor manufactured by such a method.

(b) Description of the Related Art

Conventionally, an electrophotographic process has been widely used as an image formation technology employed by copying machines, facsimile machines, printers, and like apparatus. The Carlson process (xerography) is a typical electrophotographic process, which includes six steps for printing, including electrification, exposure, development, transfer, fixing, and cleaning. Since a dedicated unit must be installed for each step, the entire system unavoidably becomes large-scaled.

The inventors have disclosed an image recording method in Patent Publication No. JP-A-1997-204092 corresponding to U.S. Pat. No. 5,815,774, as a simplified electrophotographic process to replace the Carlson process. The disclosed method employs a porous photoreceptor composed of a photoreceptor and a porous insulation layer formed on the surface of the photoreceptor. An electrode is formed on the upper surface of the porous insulation layer. Conductive coloring particles are filled into pores formed on the thus-configured porous photoreceptor. The porous photoreceptor is exposed to light corresponding to print information, thereby selectively causing the coloring particles to move in the air toward an counter electrode and be thus transferred onto recording sheet located on the near side of the counter electrode. Since this method completes printing in three steps—a coloring particles filling step, an exposure and transfer step, and a fixing step, the associated equipment can be reduced in size.

The above porous photoreceptor may be manufactured by the steps of forming pores in a sheet of the porous insulation layer by laser or drilling, and closely attaching the sheet onto the drum-shaped photoreceptor. However, a seam is formed between the abutting ends of the sheet and becomes apparent in the form of an image defect, thus impairing image quality. In the case of using a laser for forming the pores, the pores can be finely finished, and thus a high degree of image quality is obtained; however, mass productivity is rather poor with a resultant increase in cost of manufacture. In the case of forming the pores by mechanical means, such as by drilling, drilling must be repeated a tremendously large number of times. For example, when a porous layer having pores formed therein at a resolution of 200 dpi is to be formed on a cylindrical photoconductive layer having a length of 210 mm, which is the length of size A4 sheet, and a diameter of 30 mm, the number of pores to be formed becomes at least one million. Since only one pore can be formed by a single operation of drilling, drilling must be repeated at least one million times, which is not practical.

To cope with the above problems, in Japanese Patent Application No. 1997-317245, we have proposed a method for forming a porous layer in which a photo-setting liquid resin is used.

The method includes the steps of applying the photo-setting liquid resin onto a photoconductive layer; causing the applied photo-setting liquid resin to be selectively set so as to establish contrast of set portions and unset portions in correspondence with desired patterns of pores; and eliminating the unset portions to thereby form a porous layer. However, the photo-setting liquid resin encounters difficulty in forming the porous layer to a uniform thickness. In addition, since the photo-setting liquid resin usually has high viscosity, the resin involves difficulty in handling during application thereof.

In the printing method described in U.S. Pat. No. 5,815,774, image density is determined by the number of coloring particles contained in each of the larger number of pores. In order to contain a certain number of coloring particles in each pore, the diameter of the pore must assume at least a certain minimum value, or the depth of the pore must assume at least a certain minimum value, i.e., the thickness of the porous layer must assume at least a certain minimum value. The diameter of the pore is preferably decreased in order to improve resolution for printing a high-quality image. Accordingly, in order to obtain a certain image density, the depth of the pore, i.e., the thickness of the porous layer, is made to assume at least a certain minimum value. However, in the case of formation of a large number of through-pores in a photo-setting resin layer, with the increase in the thickness of the photo-setting resin layer, elimination of unset portions becomes more difficult, i.e., formation of pores becomes more difficult.

As described above, formation of the porous layer is a key technology for the printing method described in U.S. Pat. No. 5,815,774. However, although a laser can process the porous layer to a high degree of fineness with resultant high image quality, employment of a laser has a drawback of high cost due to poor mass productivity. Formation of pores by mechanical means, such as by drilling, encounters difficulty in processing the porous layer to a high degree of fineness and is thus unsuited for formation of the porous layer. In the case of the method disclosed in Japanese Patent Application No. 1997-317245, formation of the porous layer to a uniform thickness is difficult because of employment of a liquid resin. The liquid resin involves difficulty in handling during application thereof and fails to meet a demand that the porous layer be formed to at least a certain minimum thickness in order to obtain high image density.

SUMMARY OF THE INVENTION

In view of the foregoing, an object of the present invention is to provide a method for manufacturing a porous photoreceptor at low cost in which a porous layer having a uniform thickness and having equally spaced pores formed therein is easily formed on a photoreceptor.

It is another object of the present invention to provide a porous photoreceptor manufactured by such a method.

The present invention provides, in a first aspect thereof, a method for manufacturing a porous photoreceptor comprising the steps of consecutively forming a transparent conductive layer and a photoconductive layer on a transparent support member, forming an insulator layer on the photoconductive layer, and jet-blasting minute particles onto the insulator layer through a mask pattern to form pores at least in the insulator layer.

In accordance with the method of the first aspect of the present invention, the jet-blasting step provides an excellent porous layer having a uniform thickness and a pore structure in which the pores are arranged in a uniform pitch and have a uniform depth.

The present invention also provides, in a second aspect thereof, a porous photoreceptor comprising a transparent support member, and a transparent conductive layer, a photoconductive layer and an electrode layer consecutively formed on the transparent support member, the photoconductive layer having a plurality of pores arranged on the photoconductive layer, each of the pores having a bottom within the photoconductive layer.

In the porous photoreceptor of the second aspect of the present invention, porous layer has a uniform thickness and the pores are arranged at a uniform pitch thereon, resulting in an excellent porous photoreceptor providing a high printing quality.

The present invention also provides, in a third aspect thereof, a method for manufacturing a porous photoreceptor comprising the steps of consecutively forming a transparent conductive layer and a photoconductive layer on a transparent support member, and jet-blasting minute particles onto the photoconductive layer through a mask pattern to form pores in the photoconductive layer.

In the method according to the third aspect of the present invention, the porous photoreceptor according to the second aspect can be manufactured.

The above and other objects, features and advantages of the present invention will be more apparent from the following description, referring to the accompanying drawings.

DESCRIPTION OF THE PREFERRED EMBODIMENTS

Figure 1:
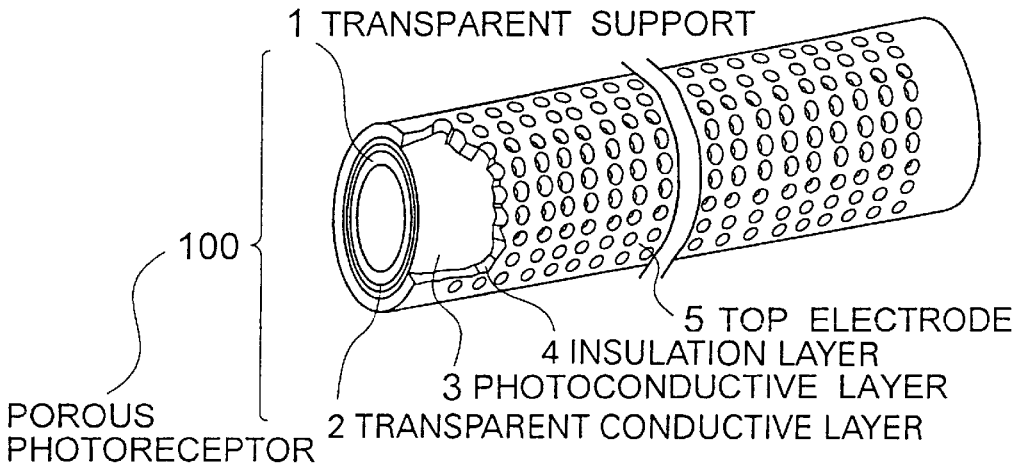
FIG. 1 is a schematic perspective view of a porous photoreceptor.

Embodiments of the present invention will next be described in detail with reference to the drawings. FIG. 1 shows a porous photoreceptor manufactured by a method according to an embodiment of the first aspect of the present invention. In FIG. 1, the porous photoreceptor 100 includes a transparent support member 1, a transparent conductive layer 2 formed on the transparent support member 1, a photoconductive layer 3 formed on the transparent conductive layer 2, and a porous layer 4 made of an insulator formed on the photoconductive layer 3. The porous layer 4 has a top electrode 5 formed on the surface thereof.

Figure 2:
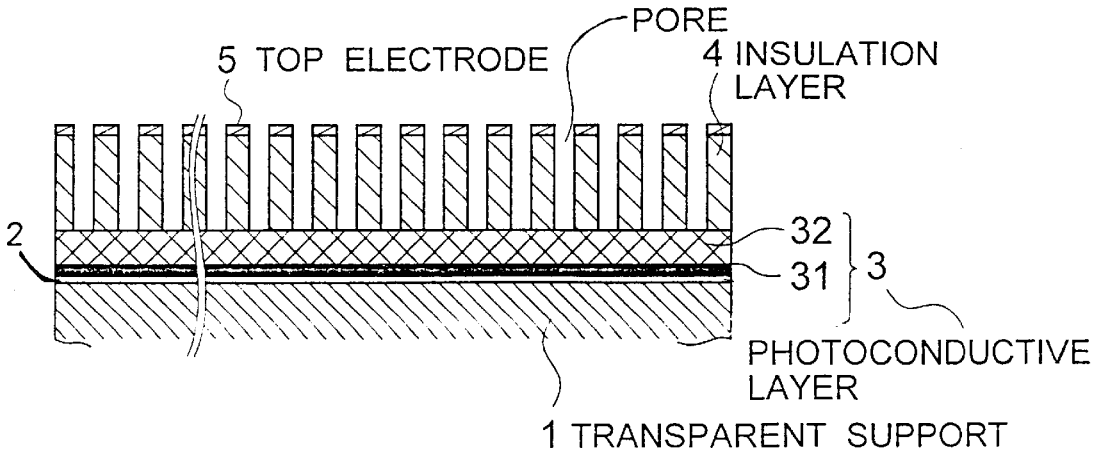
FIG. 2 is an enlarged schematic sectional view of a porous photoreceptor manufactured by a method according to a first aspect of the present invention.

FIG. 2 is an enlarged schematic sectional view of the porous photoreceptor 100 of FIG. 1. The transparent conductive layer 2 is formed by evaporation, dip coating, spray coating, or a like method. An undercoat layer may be formed between the transparent conductive layer 2 and the photoconductive layer 3. The photoconductive layer 3 is made of an inorganic or organic material. In the case of the photoconductive layer 3 of an organic material, as shown in FIG. 2, the photoconductive layer 3 includes a charge generation layer 31 formed on the transparent conductive layer 2 and containing a material for generation of charge carriers, and a charge transport layer 32 formed on the charge generation layer 31 and functioning to transport generated charges. The photoconductive layer 3 is formed by a known method employed for manufacture of an organic photoreceptor drum; for example, dip coating.

Figure 3:
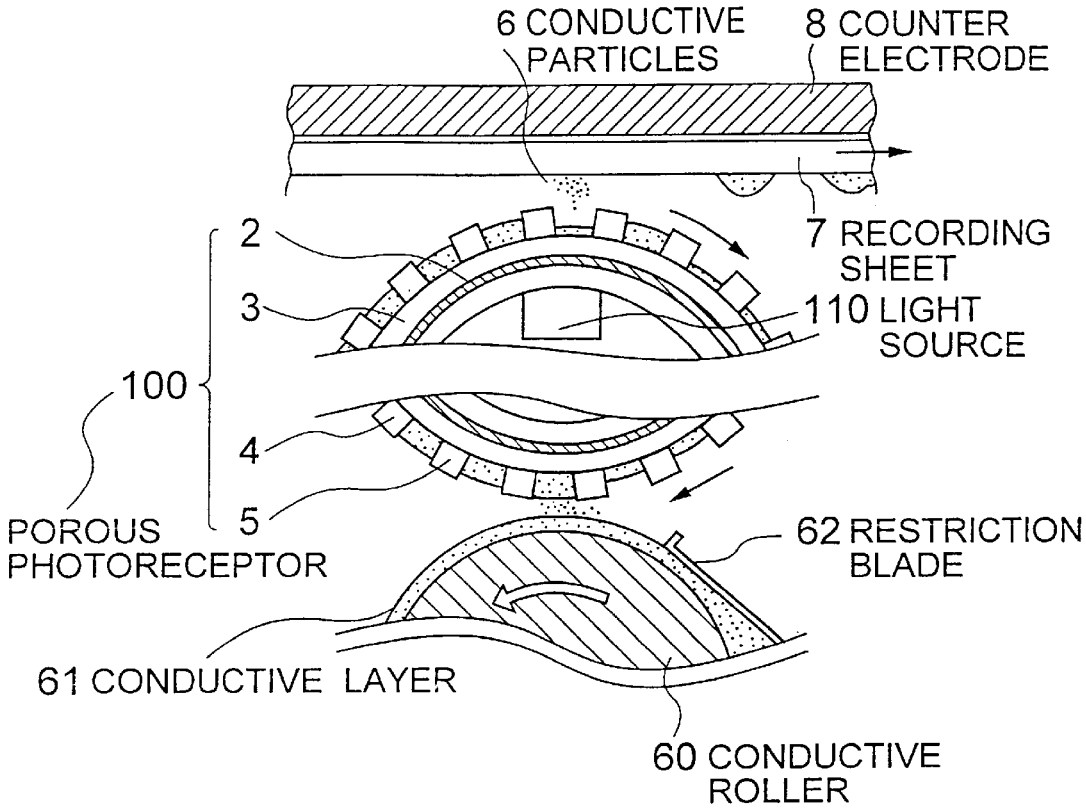
FIG. 3 is a schematic view illustrating a process for printing an image by use of the porous photoreceptor according to the present invention.

FIG. 3 schematically shows a process for printing an image by use of the porous photoreceptor 100 of FIG. 1. In FIG. 3, a conductive roller 60 is spaced apart from the porous photoreceptor 100, and a recording sheet 7 and an counter electrode 8 are spaced apart from the porous photoreceptor 100 and are located downstream of the conductive roller 60 along the rotational direction of the porous photoreceptor 100. Conductive particles 6 are fed onto the conductive roller 60 and are thinned into a thin conductive-particle layer 61 by a restriction blade 62. The counter electrode 8 is located on the far side of the recording sheet 7 with respect to the porous photoreceptor 100.

A voltage is applied among the transparent conductor layer 2, the top electrode 5, and the conductive roller 60 so as to generate an electric field between the transparent conductor layer 2 and the conductive roller 60 at a position where the porous photoreceptor 100 faces the conductive roller 60. The conductive particles 6 on the conductive roller 60 are electrified to negative polarity by the electric field and are attracted into pores formed in the porous layer 4. The conductive particles 6 colliding against the top electrode 5 are electrified to positive polarity by the electric field and return to the conductive roller 60. Accordingly, the conductive particles 6 of negative polarity fill only the pores formed in the porous layer 4. The conductive particles 6 are contained in the pores such that the electric potential thereof becomes equal to that of the top electrode 5, so that the electric field of the surface of a particle layer approaches zero. Therefore, the filling conductive particles 6 are confined in the pores.

In an image recording section where the porous photoreceptor 100 faces the recording sheet 7, a potential difference is established so as to generate an electric field directed from the transparent conductive layer 2 to the counter electrode 8. When the photoconductive layer 3 is irradiated with light emitted from a light source 110 in accordance with an image to be printed, the exposed portion of the photoconductive layer 3 increases in electric conductivity; consequently, charge established in the conductive particles 6 contained in the corresponding pores leak out through the photoconductive layer 3.

As a result of the leakage of charge, the electric potential of the conductive particles 6 contained in the pores approaches that of the transparent conductive layer 2, so that an electric field is generated on the surface of the layer of the conductive particles 6. The conductive particles 6 located on the side of the top electrode 5 are electrified to positive polarity and move out of the corresponding pores to the recording sheet 7. The released conductive particles 6 attach onto the recording sheet 7, thereby forming an image thereon. As seen from the above description, the arrangement pitch of pores and the diameter of each pore directly determine image density. In order to obtain as high an image density as possible, the shape and arrangement of pores must be optimized so as to narrow the arrangement pitch of pores and to increase the pore diameter. For efficient printing on a recording sheet, it is preferred that an image be formed on a photoconductive layer of a cylindrical shape or a like shape and that the photoconductive layer be rotated for continuous printing. Therefore, a method for manufacturing a cylindrical, porous photoreceptor will next be described.

Figure 4:
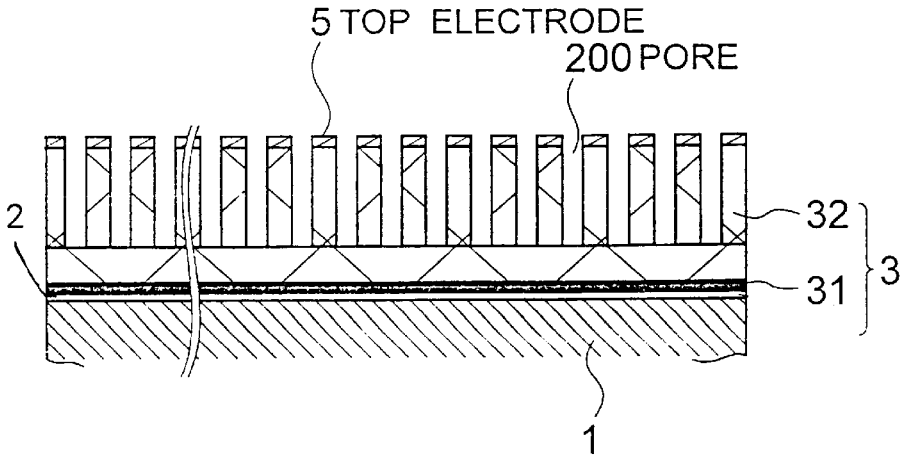
FIG. 4 is an enlarged schematic sectional view of a porous photoreceptor according to a second aspect of the present invention.

The text includes descriptions in relation to the first to third aspects of the present invention. The first aspect of the present invention is directed to a method for manufacturing a porous photoreceptor, including the step of disposing on a photoconductive layer a porous layer in which pores are formed by jet-blasting or sandblasting. The second aspect of the present invention is directed to a porous photoreceptor in which pores are formed in a surface portion of a charge transport layer corresponding to the charge transport layer 32 of FIG. 4. The third aspect of the present invention is directed to a method for manufacturing a porous photoreceptor, including the steps of: forming a charge transport layer thicker than that formed in a conventional electrophotographic process; and forming pores in the charge transport layer by sandblasting. FIG. 4 is an enlarged schematic sectional view of the porous photoreceptor according to the second aspect or that manufactured by the method according to the third aspect. The first, second, and third aspects will next be described in detail with reference to the drawings.

Figure 5:
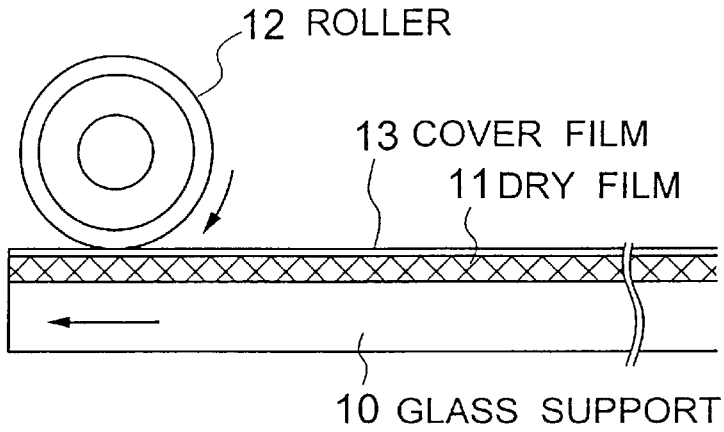
FIG. 5 is a schematic view illustrating attachment of a photo-setting dry film onto a support.

FIG. 5 illustrates a first step in manufacture of a dry film having a mask pattern for use in sandblasting which is common to the first and third aspects. A dry film 11 is used as a sheet resist. The present embodiment uses a negative photo-setting dry film of BF Series (product of Tokyo Ohka Kogyo Co., Ltd.) as a resist material of the dry film for use in sandblasting. The dry film 11 has a relatively small thickness of 50 $\mu$m in order to facilitate formation of through-pores therein at fine pitches, which will be described later. In FIG. 5, a flat glass plate having a thickness of about 5 mm and good flatness, for example, is used as a glass support 10. A lower cover film is removed from the photo-setting dry film 11 in preparation for attachment onto the glass support 10. The thus-prepared photo-setting dry film 11 is attached onto the glass support 10 through application of heat and pressure by a thermal pressure roller 12 (having a temperature of about 115° C.) in such a manner as not to catch bubbles therebetween. Subsequently, an upper cover film 13 is removed from the dry film 11. A desired pore pattern may be formed on the dry film 11 through exposure effected by either method described below.

Specifically, a mask on which a pore pattern is printed is placed on the dry film 11 so as to maintain close contact therewith. Then, the entire dry film 11 is subjected to exposure. Alternatively, a laser beam whose wavelength causes setting of the photo-setting dry film 11 is focused and scanned on the dry film 11 so as to effect exposure for formation of a pore pattern, without using a mask pattern. The former exposure method is simple; however, involves a drawback in that a mask must be remade each time a pore pattern is modified, which is uneconomical. The latter exposure method facilitates modification of a pore pattern through modification of pore pattern data to be output from a computer; however, involves a drawback in that outputting CAD data is time consuming, since scanning is performed on a pore-by-pore basis. The method to be used may be determined according to the shape or form of an object of exposure.

Figure 6:
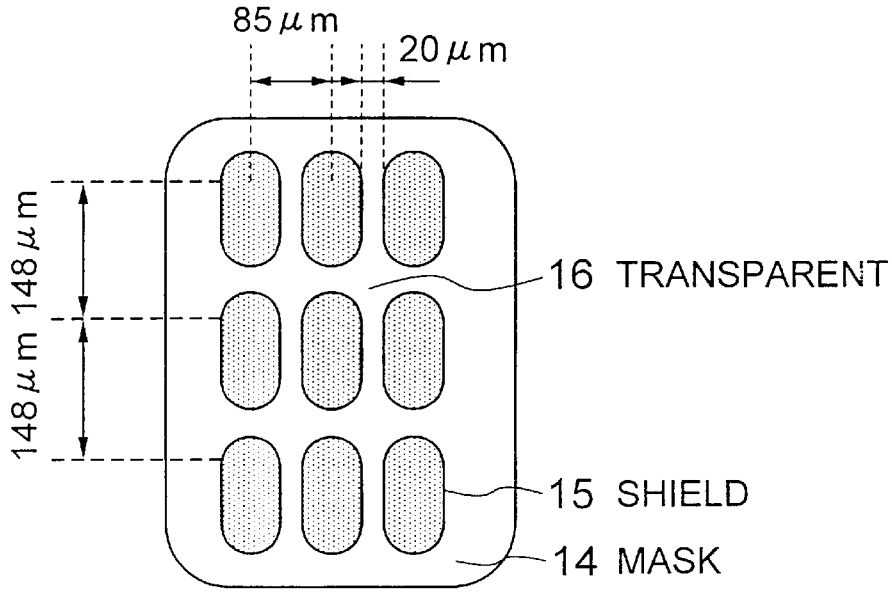
FIG. 6 is a partially enlarged plan view of a mask which is to be closely attached onto the photo-setting dry film and on which a pore pattern is printed.

The present embodiment employs the former exposure method using a mask. However, the latter exposure method using a laser may also be effectively employed. FIG. 6 is a partially enlarged top plan view of a patterned mask 14. The patterned mask 14 is closely attached onto the dry film 11 through application of heat and pressure. The present embodiment uses the patterned mask 14 on which a pattern of slots as shown in FIG. 6 is printed. The thermal pressure roller 12 of FIG. 5 is used for closely attaching the patterned mask 14 onto the dry film 11 in order to prevent a failure in forming an exact image of the pattern on the dry film 11 and oxygen-induced desensitization of the photo-setting dry film 11, which might otherwise result from air caught therebetween. On the other hand, employment of the thermal pressure roller 12 causes reduction in the thickness of the dry film 11 due to heat and high pressure. For example, the thickness of the dry film 11 employed in the present embodiment decreases from 50 $\mu$m to about 45 $\mu$m.

The dimensions and arrangement of patterns printed on the patterned mask 14 are determined so as to correspond to those of pores formed on a porous photoreceptor manufactured by the method of the invention. The arrangement pitch of pores depends on the quality; particularly, the resolution, of an image to be printed by use of the porous photoreceptor. The shape of each pore and the wall thickness between pores depend on the number of conductive coloring particles filling each pore and a printing speed. FIG. 6 exemplifies patterning on the patterned mask 14, and patterning is not limited thereto. The dry film 11 used in the present invention is of the negative type; in other words, an exposed portion becomes set through photocrosslinking and photopolymerization of a polymer chain. Thus, in FIG. 6, a light shield portion 15 corresponding to a pore is in the form of a black pattern so as not to permit transmission of light for exposure.

Figure 7:
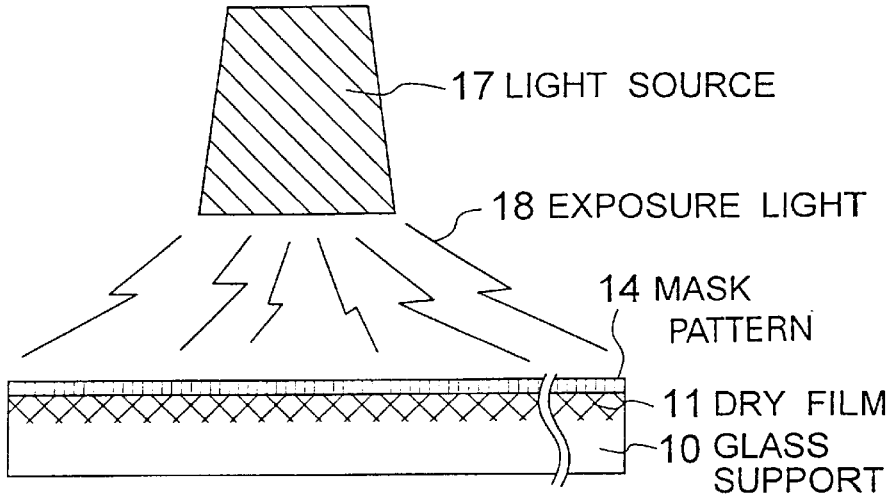
FIG. 7 is a schematic view illustrating the step of transferring a pore pattern onto the photo-setting dry film through exposure.
Figure 8:
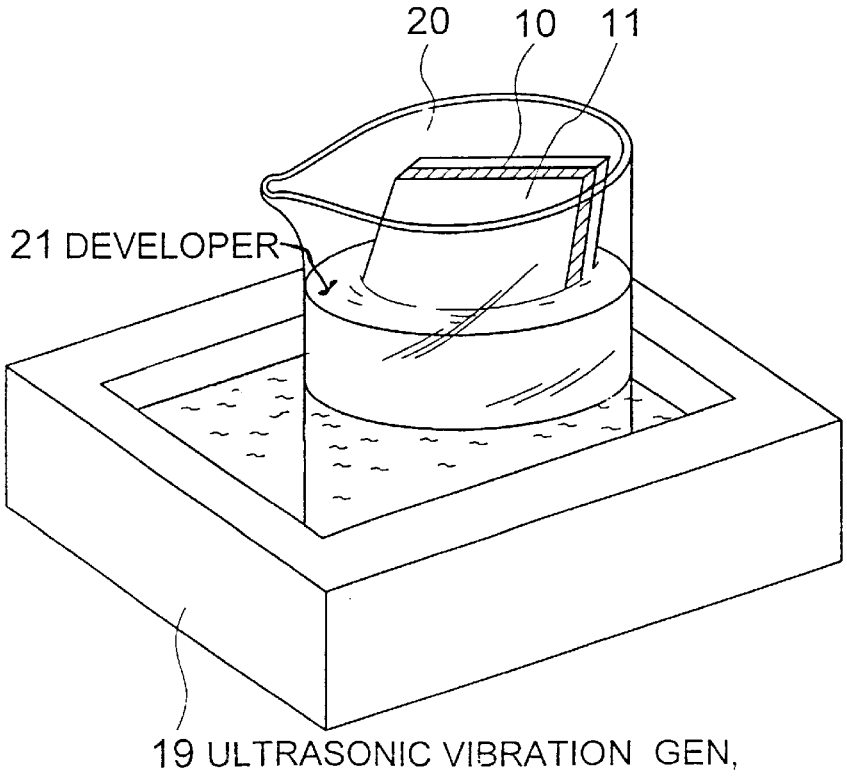
FIG. 8 is a schematic perspective view illustrating the step of developing the dry film.

FIG. 7 schematically illustrates the step of transferring a pore pattern of the mask onto the photo-setting dry film 11 through exposure. This step establishes contrast of set portions and unset portions on the dry film 11. FIG. 8 illustrates the step of removing unset portions from the photo-setting dry film 11 which has undergone the exposure step, to thereby form through-pores in the dry film 11. Specifically, the dry film 11 is immersed, for about 1 minute, in a developer 21 contained in an ultrasonic vibration generator 19 so as to form through-pores therein. The developer 21 is heated to a temperature of 30° C. and is adapted to dissolve only the unset portions of the dry film 11. Alternatively, a high-pressure developer may be sprayed over the dry film 11 for selective development. Next, the developer is washed off the dry film 11 by use of pure water. Then, the dry film 11 is dried at a temperature of 60° C. for 10 minutes in a thermostatic oven. Subsequently, the dry film 11, which serves as a sheet resist, is removed from the glass support 10.

The thus-manufactured dry film 11 has a large number of through-holes formed uniformly therein and serves as a sheet resist used in common with the methods of the first and third aspects. The dry film 11 is resistant to abrasion exerted by abrasive grains sprayed under high pressure during sandblasting, which will be described later. Thus, being attached onto an object to be sandblasted, the dry film 11 serves as a mask during sandblasting.

The first and third aspects are different in the methods used for manufacturing a porous photoreceptor. According to the first aspect, the insulation layer 4 is formed on the photoconductive layer 3 and is then sandblasted so as to form pores therein. A process for forming the insulation layer 4 on the photoconductive layer 3 will next be described.

Figure 9:
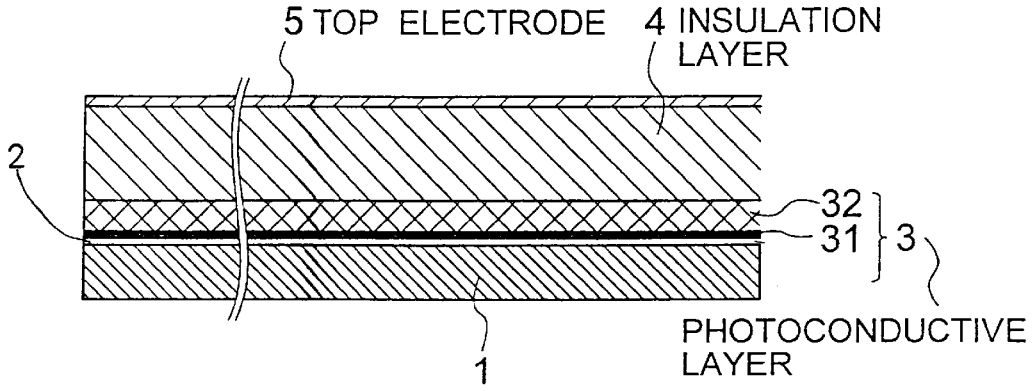
FIG. 9 is a schematic sectional partial view of a blank photoreceptor in an embodiment of the first aspect of the present invention.

FIG. 9 is a schematic sectional partial view of a blank photoreceptor 100 in which pores are not formed yet in the insulation layer 4. The insulation layer 4 has a thickness of about 100 μm and is formed on the photoconductive layer 3. A layer of the top electrode 5 having a thickness of about 250 angstroms is previously formed on the surface of the insulation layer 4 through vacuum evaporation. The top electrode 5 may be formed through evaporation or electroless plating of metal, such as aluminum, gold, or bismuth, or ITO. The surface of the top electrode 5 may be coated with a conductive polymer. As described previously, the top electrode 5 has the following three functions: (1) to form a high electric field within the photoconductive layer 3; (2) to confine the conductive particles 6 in pores; and (3) to prevent adhesion of the conductive particles 6 onto the surface of the porous photoreceptor 100. Therefore, the top electrode 5 is an indispensable element.

A thermosetting epoxy resin is used as material for the insulation layer 4 for the following reasons: coating is easy to perform; adhesion to a base layer is excellent; shrinkage is hardly observed after setting; and suitable strength is exhibited after setting. The insulation layer 4 is formed in a manner similar to that for forming a charge transport layer constituting a photoconductive layer, as observed in a conventional method for manufacturing an electrophotographic photoreceptor. Specifically, a photoreceptor is dipped in a liquid coating of a thermosetting epoxy resin and is then pulled up at a constant rate to thereby coat the photoreceptor with a layer of the epoxy resin having a uniform thickness. Subsequently, the epoxy resin layer is set through application of heat. Alternatively, another polymer dissolved in a solvent may be applied onto the photoreceptor in a similar manner, followed by drying. A known coating method, such as blade coating, may also be employed.

In the present embodiment, the charge generation layer 31 assumes a thickness of about 0.05 to 1 μm, and the charge transport layer 32 assumes a thickness of about 20 μm. The charge generation layer 31 is made of n-type titanyl phthalocyanine and polyvinyl butyral described in, for example, Patent Publication No. JP-A-1991-9962. Material for the charge transport layer 32 is prepared by the steps of dissolving polycarbonate serving as a binder resin in a solvent, and adding to the resultant solution a charge transport material described in, for example, Patent Publication No. JP-A-1995-168376, in an amount of 20 to 40 wt %. The insulation layer 4 described above is sandblasted, as described later, so as to form pores therein, thereby obtaining a porous layer from the insulation layer 4.

Figure 10:
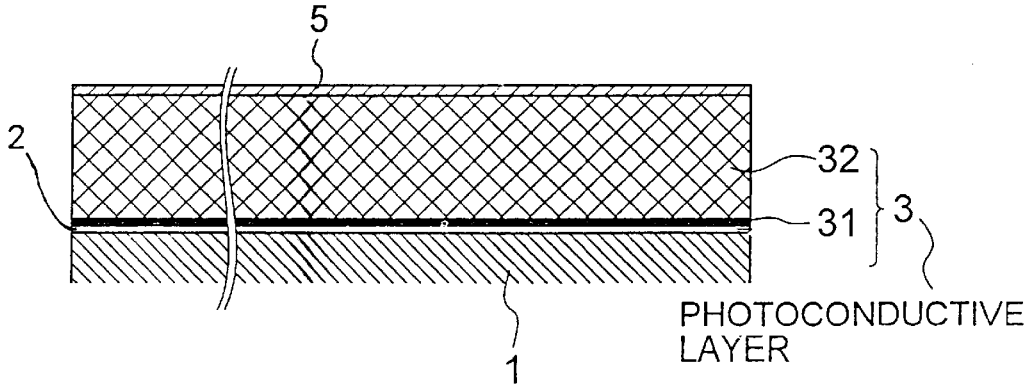
FIG. 10 is a schematic sectional partial view of a blank photoreceptor in an embodiment of the second aspect of the present invention.

Next will be described a porous photoreceptor according to the second aspect. In the porous photoreceptor, pores are formed in a surface portion of the charge transport layer 32 constituting the photoconductive layer 3. FIG. 10 is a schematic sectional partial view of a blank photoreceptor in which pores are not formed yet in the photoconductive layer 3. The photoconductive layer 3 is composed of the charge generation layer 31 and the charge transport layer 32. As in the case of the first aspect, a layer of the top electrode 5 is previously formed on the surface of the charge transport layer 32 through evaporation of aluminum and assumes a thickness of about 250 angstroms. A material for the top electrode 5 and a method for forming the top electrode 5 are not limited thereto. The top electrode 5 may be formed of other metal or conductive material by other method.

In an actual printing process, when the photoconductive layer 3 is irradiated with light for exposure in accordance with print information, the charge generation layer 31 generates charges according to an amount of the exposure. The charge transport layer 32 is adapted to transport the thus-generated charges to the surface of the photoconductive layer 3, thereby neutralizing counter charges adhering to the surface and electrified to a polarity opposite to that of the generated charges, and thus eliminating charges from the surface.

According to the second aspect, pores, the depth of each of which is less than the thickness of the charge transport layer 32, are uniformly formed in the surface portion of the charge transport layer 32, so that the surface portion functions as a porous layer. Usually, the charge generation layer 31 assumes a thickness of about 0.1 to 1 μm, and the charge transport layer 32 assumes a thickness of about 5 to 50 μm. In the second aspect, since the surface portion of the charge transport layer 32 assumes the form of a porous layer, the charge transport layer 32 assumes a larger thickness, specifically 100 to 150 μm.

The charge generation layer 31 is made of n-type titanyl phthalocyanine and polyvinyl butyral disclosed in, for example, Japanese Patent Application No. 1989-144889. Material for the charge transport layer 32 is prepared by the steps of dissolving in a solvent polystyrene which has higher hardness than that of polycarbonate and is abradable when sandblasted, and which serves as a binder resin; and adding to the resultant solution a charge transport material disclosed in, for example, Patent Publication No. JP-A-1995-168376, in an amount of 20 to 40 wt %. Polycarbonate may be used as the binder for abrasive grains of a certain type or a certain sandblasting pressure, which will be described later.

The porous photoreceptor according to the second aspect and as described above is manufactured by the method of the third aspect. Specifically, the dry film 11, which serves as a sheet resist and in which through-holes are formed by the method described previously, is attached onto the charge transport layer 32. The charge transport layer 32 covered with the dry film 11 is subjected to sandblasting, which will be described layer, i.e., a stream of abrasive grains projected by compressed air is blown against the charge transport layer 32 via the dry film 11, thereby forming pores in the charge transport layer 32.

As described above, the insulation layer 4 serving as the porous layer is formed on the photoconductive layer 3 by the method of the first aspect, or the surface portion of the photoconductive layer 3 is formed into the porous layer 4 by the method of the third aspect. Next will be described in detail a method for forming pores in the insulation layer 4, or the surface portion of the photoconductive layer by sandblasting through the dry film 11 serving as a sheet resist and attached thereto, or brought into contact therewith.

Figure 11:
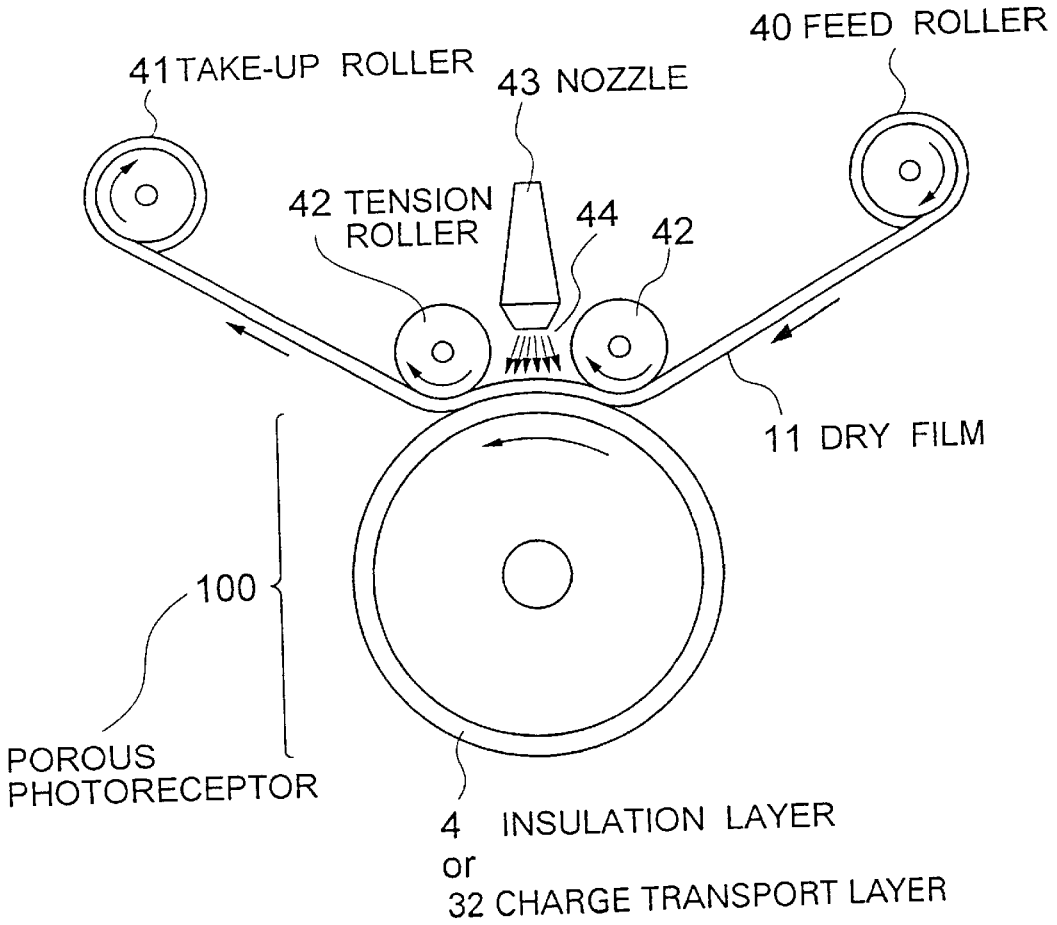
FIG. 11 is a schematic view illustrating a sandblasting process by use of the dry film.

FIG. 11 schematically illustrates a process of forming the porous layer 4 by sandblasting in the method of the first or third aspect. A feed roller 40 and a take-up roller 41 are rotated to feed the dry film 11, in which through-holes are formed by use of the patterned mask of FIG. 6 and which serves as a sheet resist, in the direction of the arrow. Tension rollers 42 exert tension on the dry film 11 to prevent the dry film 11 from wrinkling and to exert an appropriate nip on the surface of contact between the dry film 11 and the insulation layer 4 or the charge transport layer 32. Nozzles 43 are arranged equally spaced in a line and in such a manner as to face the nip portion.

A stream of abrasive grains 44 is projected by compressed air from each nozzle 43 and is blown against the insulation layer 4 or the charge transport layer 32 through pattern of the dry film 11. The projected abrasive grains 44 pass through the through-holes formed in the dry film 11 and reach the insulation layer 4 or the charge transport layer 32 to thereby abrade the layer 4 or 32. The abrasive grains 44 are of silicon dioxide and are blown against a nip portion of a 5 mm width at a blast pressure of 4 kg/cm$^2$ for 10 sec to 180 sec. Through optimization of such blasting conditions, the abrasive grains 44 may be of alumina, glass beads, or a like material used commonly for jet-blasting or sandblasting. A material for the abrasive grains 44 is determined according to the material and hardness of an object to be sandblasted.

Figure 12:
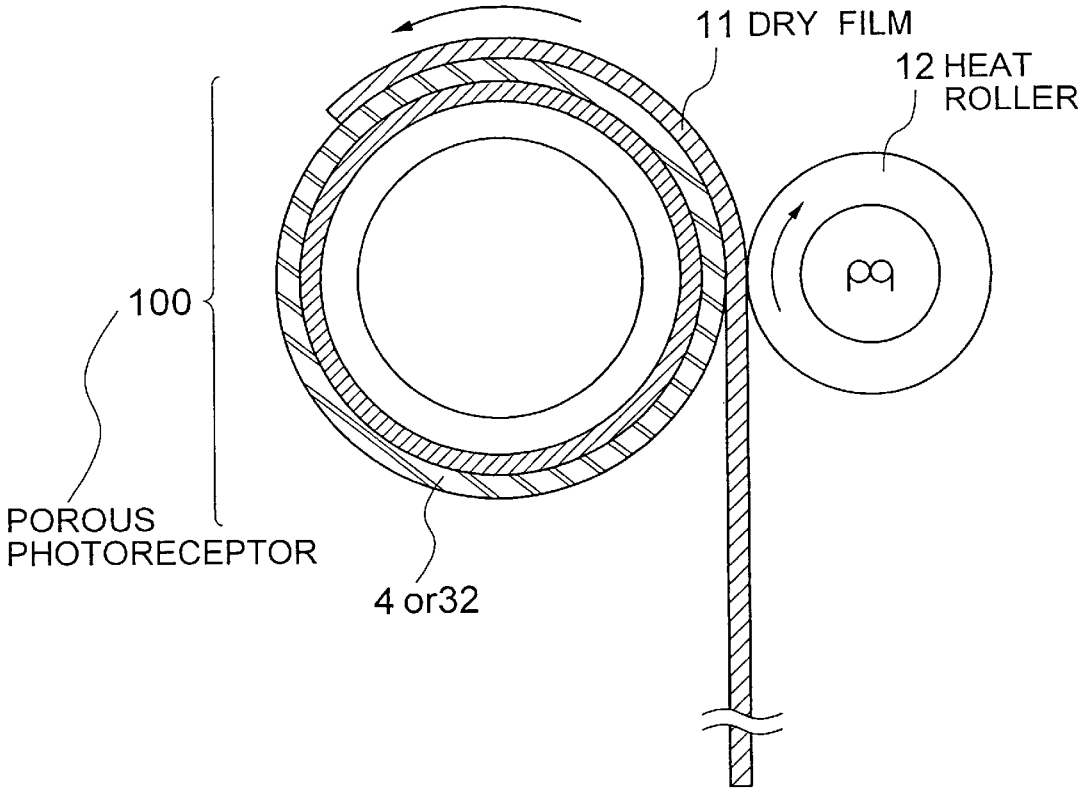
FIG. 12 is a schematic cross-sectional view illustrating a process for attaching the dry film onto a blank photoreceptor in preparation for sandblasting performed in a manner different from that of FIG. 11.

FIG. 12 illustrates a process for attaching the dry film 11 onto a blank photoreceptor in preparation for sandblast to be performed in a manner different from that of FIG. 11. The dry film 11 serving as a sheet resist is closely wound onto the metal-deposited insulation layer 4 or the charge transport layer 32 through application of heat and pressure in a manner similar to that of FIG. 5. The thermal pressure roller 12 heated to a temperature of about 115° C. is rotated and pressed against the porous photoreceptor 100 with the dry film 11 held therebetween, while the porous photoreceptor 100 is rotated at a peripheral speed equal to that of the thermal pressure roller 12. The dry film 11 is then patterned with pre-determined holes to act as a sheet resist. Subsequently, the abrasive grains 44 are blown against the rotating photoreceptor 100 by use of a sandblaster equipped with the nozzles 43 arranged in parallel lines, thereby forming pores in the insulation layer 4 or the charge transport layer 32.

Figure 13:
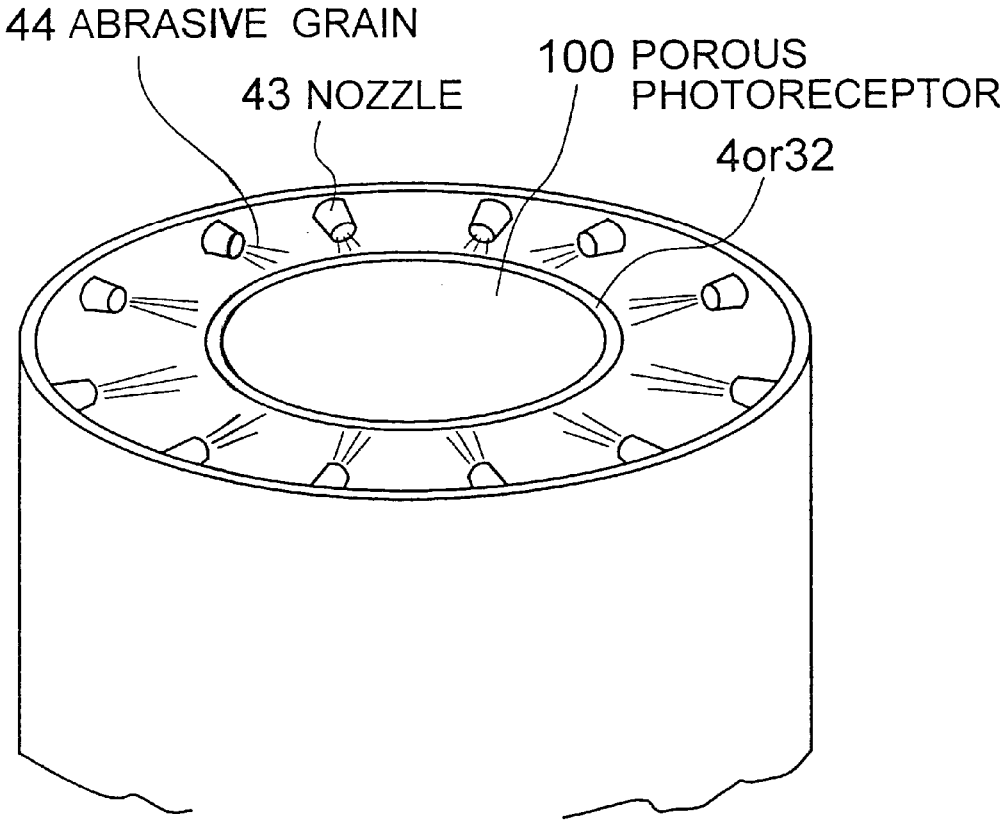
FIG. 13 is a schematic perspective view illustrating sandblasting performed in a manner different from that of FIG. 11.

Referring to FIG. 13, the nozzles 43 may be arranged all around the photoreceptor 100, so that the abrasive grains 44 are blown against the porous photoreceptor 100 along the entire circumference thereof. This method is preferable in that sandblasting time is shortened. The abrasive grains 44 and the blast pressure are similar to those employed in the sandblasting process of FIG. 11. After the elapse of a predetermined sandblasting time, formed pores are checked to see if they are as deep as desired; for example, 100 $\mu$m deep. The dry film 11 is removed by pulling an end thereof. A release agent may be used for removing the dry film 11.

Figure 14:
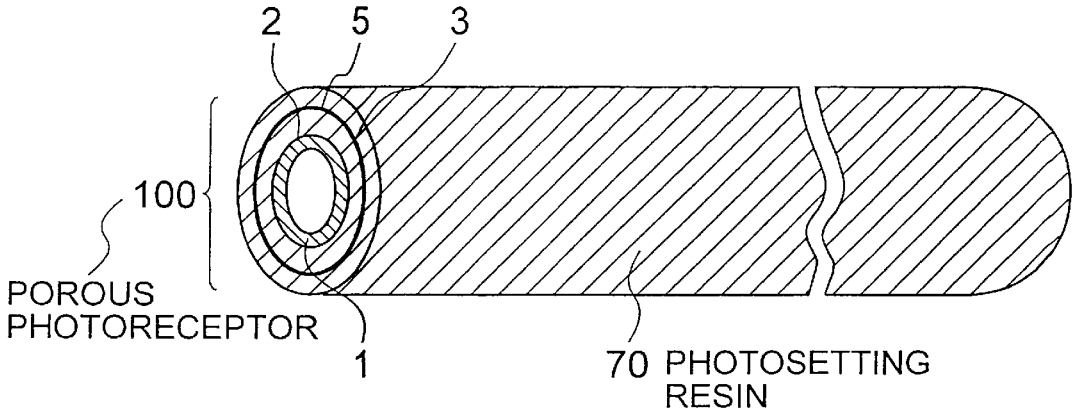
FIG. 14 is a schematic perspective view of a blank photoreceptor as viewed immediately after a photo-setting resin is applied thereto.

A method for manufacturing a porous photoreceptor according to another embodiment of the present invention will next be described. The method includes the steps of applying a photo-setting liquid resin onto a charge transport layer or an insulation layer, which is to be formed into a porous layer covered with an electrode layer; forming a pattern on the applied photo-setting resin layer through exposure; and developing and drying the photo-setting resin layer to yield a resist layer. FIG. 14 is a view of a blank photoreceptor as viewed immediately after the photo-setting resin is applied thereto. In the present embodiment, the photo-setting liquid resin APR manufactured by Asahi Chemical Industry Co., Ltd. is used as a photo-setting resin 70. Since the photo-setting resin APR has high viscosity at room temperature, the resin APR is heated to a temperature of about 50° C. so as to decrease viscosity.

The thus-heated resin APR is uniformly applied onto the cylindrical charge transport layer 32 or the cylindrical insulation layer 4 to thereby yield a layer of the photo-setting resin 70 of a uniform thickness, followed by cooling. Subsequently, a pore pattern of FIG. 6 is transferred onto the photo-setting resin 70 through exposure effected by the method of FIG. 7. Then, the photo-setting resin 70 is subjected to development so as to remove unset portions, thereby forming pores therein. Subsequently, the photoreceptor is subjected to sandblast in which a stream of abrasive grains projected by compressed air is blown against the layer of the porous photo-setting resin 70, thereby forming pores in the charge transport layer 32 or the insulation layer 4. Then, the layer of the photo-setting resin 70 is removed in a manner described previously.

Figure 15:
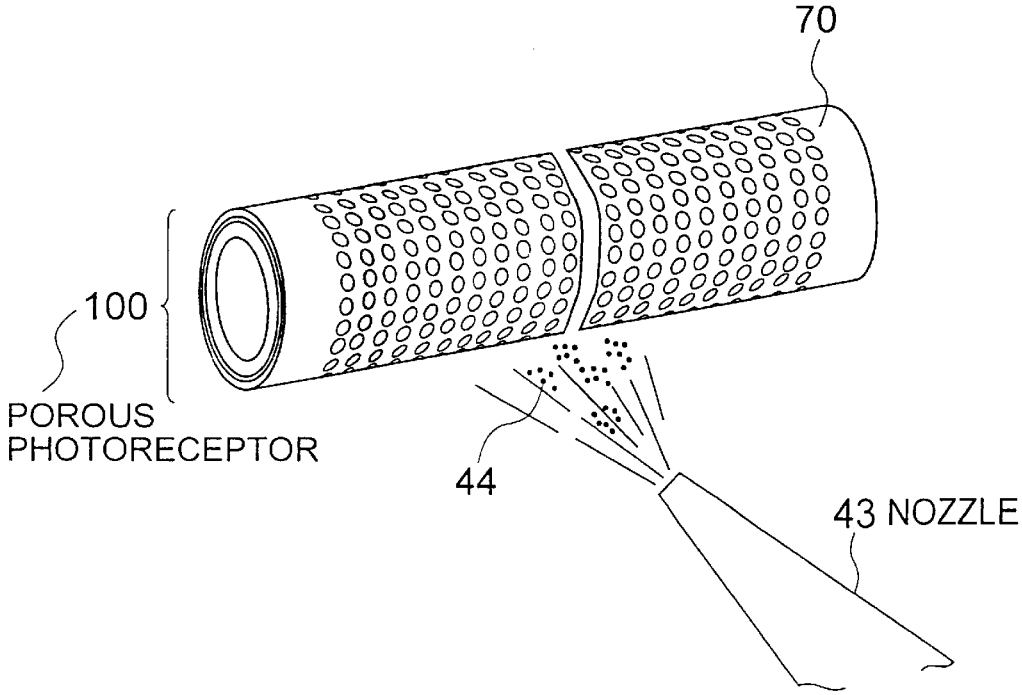
FIG. 15 is a schematic perspective view illustrating sandblasting of the blank photoreceptor of FIG. 14.

FIG. 15 is a schematic view illustrating sandblasting of the blank photoreceptor of FIG. 14. According to the method of the present embodiment, a step of forming the resist layer, a step of sandblasting, and a step of removing the resist layer can be performed continuously while the photoreceptor is supported in place; in other words, a step of removing the dry film 11 from a glass support and a step of attaching the dry film 11 onto an object to be sandblasted are not involved. This method exhibits excellent mass productivity and is thus suited for manufacturing a large number of porous photoreceptors of the invention.

The present invention yields the following effects. Whether the thickness of a photo-setting resin film used as sandblast resist is feasible depends on whether the photo-setting resin film of the thickness concerned is resistant to abrasive grains blown at high speed against the film. A thin photo-setting resin film is usable so long as the film exhibits such resistance. Thus, minute pores required for printing of high image quality can be easily formed in the photo-setting resin film, so that an image of high resolution can be printed. Since a top electrode layer is formed in advance before the step of forming pores, choking of pores is not involved in contrast to a method in which, after pores are formed in a layer formed on a photoreceptor, a top electrode layer is attached onto the porous layer.

According to the first aspect, a porous layer may be made of any material so long as the material can be effectively abraded by abrasive grains and has an electrically insulating property. Thus, in contrast to a method in which a photo-setting resin is used as the porous layer, there is a good choice of materials for the porous layer. According to the second and third aspects, a surface portion of the charge transport layer constituting the photoconductive layer is adapted to function as the porous layer, thereby eliminating a step of attaching an insulation layer onto a photoreceptor. Therefore, a porous photoreceptor suited for mass production can be manufactured.

Since the above embodiments are described only as examples, the present invention is not limited to the above embodiments and various modifications or alterations can be easily made therefrom by those skilled in the art without departing from the scope of the present invention.

What is claimed is:

1. A method for manufacturing a porous cylindrical photoreceptor drum comprising the steps of:

forming a cylindrical photoreceptor drum by forming a transparent conductive layer on a transparent cylindrical support member, and forming a heterogenous multilayer conductive particle receiving layer on the transparent conductive layer;

rotating the cylindrical photoreceptor drum around an axis along a centerline of the drum;

placing a moving mask pattern having pre-determined holes in momentary intimate contact with a circumferential contact surface of the rotating cylindrical photoreceptor drum, wherein the instantaneous relative velocity between the moving mask pattern and the rotating cylindrical photoreceptor drum is zero along the circumferential contact surface; and forming pores in the heterogenous multilayer conductive particle receiving layer by jet-blasting minute particles through the pre-determined holes in the moving mask pattern along the circumferential contact surface and into the rotating heterogenous multilayer conductive particle receiving layer.

2. The method of claim 1, further comprising the steps of:

forming a top electrode layer on the heterogenous multilayer conductive particle receiving layer before the rotating and jet-blasting steps.

3. The method of claim 2, wherein the heterogenous multilayer conductive particle receiving layer further comprises:

a multilayer photoconductive layer having a charge generation layer formed on the transparent conductive layer and a charge transport layer formed on the charge generation layer, and wherein the charge transport layer has a thickness in the range of 100–150 $\mu$m, and wherein a bottom of the pores is within the photoconductive layer.

4. The method of claim 2, wherein the heterogenous multilayer conductive particle receiving layer further comprises an insulator layer formed on a multilayer photoconductive layer, and wherein a bottom of the pores is within the insulator layer.

5. The method of claim 2, wherein the moving mask pattern is formed in a photo-setting dry film.

6. A method for manufacturing a porous cylindrical photoreceptor drum comprising the steps of:

forming a transparent conductive layer on a transparent cylindrical support member;

forming a heterogenous multilayer conductive particle receiving layer on the transparent conductive layer;

forming a top electrode layer on the heterogenous multilayer conductive particle receiving layer;

applying a photo-setting dry film to an entirety of a circumferential peripheral surface of the cylindrical photoreceptor drum on the top electrode to form an intermediate photoreceptor drum assembly;

patterning the photo-setting dry film to form a mask pattern having a plurality of pre-defined holes;

placing the intermediate photoreceptor drum assembly in a sandblaster having a plurality of nozzles arranged surrounding the intermediate photoreceptor drum assembly;

jet-blasting minute particles through the predefined holes in the mask pattern, through the top electrode layer, and into the multilayer conductive particle receiving layer, thereby forming pores in the multilayer conductive particle receiving layer; and removing the photo-setting dry film mask pattern from the cylindrical photoreceptor drum.

7. The method of claim 6, wherein the heterogenous multilayer conductive particle receiving layer further comprises an insulator layer formed on a multilayer photoconductive layer, and wherein a bottom of the pores is within the insulator layer.

8. The method of claim 6, wherein the heterogenous multilayer conductive particle receiving layer further comprises a multilayer photoconductive layer having a charge generation layer formed on the transparent conductive layer, and a charge transport layer formed on the charge generation layer, and wherein the charge transport layer has a thickness in the range of 100–150 $\mu$m, and wherein a bottom of the pores is within the photoconductive layer.

9. The method of claim 6, wherein the applying and patterning steps of the photo-sensitive dry film comprise:

applying a heated photo-sensitive resin onto the surface of the top electrode;

cooling the photo-sensitive resin;

transferring a pore pattern onto the photo-sensitive resin through exposure; and developing and drying the photo-sensitive resin to remove unset portions and create pores.

10. The method of claim 9, wherein the transferring step comprises a laser scanning exposure step.

11. The method of claim 9, wherein the transferring step comprises a lamp and exposure mask step.

* * * * *